US009901950B1

(12) United States Patent
Thompson

(10) Patent No.: US 9,901,950 B1
(45) Date of Patent: Feb. 27, 2018

(54) TELESCOPIC PAINT POLE SYSTEM

(71) Applicant: Donald Thompson, Cleveland, OH (US)

(72) Inventor: Donald Thompson, Cleveland, OH (US)

( * ) Notice: Subject to any disclaimer, the term of this patent is extended or adjusted under 35 U.S.C. 154(b) by 0 days.

(21) Appl. No.: 15/257,309

(22) Filed: Sep. 6, 2016

(51) Int. Cl.
*B05B 15/08* (2006.01)
*B05B 11/00* (2006.01)

(52) U.S. Cl.
CPC ..... *B05B 15/08* (2013.01); *B05B 11/30* (2013.01)

(58) Field of Classification Search
CPC ... B05B 15/065; B05B 15/066; B05B 15/067; B05B 15/068; B05B 9/0426; B05B 9/043; B05B 9/085; B05B 9/0855; B05B 9/0861; B05B 11/30; B05B 15/08
See application file for complete search history.

(56) References Cited

U.S. PATENT DOCUMENTS

| | | | | |
|---|---|---|---|---|
| 2,520,397 | A * | 8/1950 | Green | B05B 1/265 118/306 |
| 3,284,114 | A | 11/1966 | McCord, Jr. | |
| 3,915,382 | A | 10/1975 | Davis | |
| 4,457,472 | A | 7/1984 | Geberth, Jr. | |
| D354,554 | S | 1/1995 | Newman, Sr. | |
| 5,485,960 | A | 1/1996 | Troudt | |
| 6,446,884 | B1 * | 9/2002 | Utter | A01G 25/145 222/386 |
| 6,546,596 | B2 | 4/2003 | Grote | |
| 6,976,644 | B2 | 12/2005 | Troudt | |
| 7,237,305 | B2 | 7/2007 | Newman | |

* cited by examiner

*Primary Examiner* — Christopher Kim

(57) ABSTRACT

The telescopic paint pole system is an extensible spray painting system that is adapted for use in painting raised surfaces without the use of a supporting structure such as a ladder. The telescopic paint pole system comprises a telescopic shaft, a paint pump system, and a spray head. The paint pump system is integrated into the telescopic shaft. The spray head is attached to the paint pump system. The spray head is detachable and replaceable. The length of the telescopic shaft is adjustable which allows for adjustment of the height the telescopic paint pole system can reach.

5 Claims, 7 Drawing Sheets

COTTER PIN

SPRING LOADED
BALL LOCK

G SNAP COLLAR

SPLIT COLLAR LOCK

THREADED CLUTCH

TELESCOPIC PAINT POLE SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of spraying or atomizing apparatus for separating or mixing materials, more specifically, a spraying apparatus and associated mounting not otherwise provided for.

SUMMARY OF INVENTION

The telescopic paint pole system is an extensible spray painting system that is adapted for use in painting raised surfaces without the use of a supporting structure such as a ladder. The telescopic paint pole system comprises a telescopic shaft, a paint pump system, and a spray head. The paint pump system is integrated into the telescopic shaft. The spray head is attached to the paint pump system. The spray head is detachable and replaceable. The length of the telescopic shaft is adjustable which allows for the adjustment of the height that the telescopic paint pole system can reach.

These together with additional objects, features and advantages of the telescopic paint pole system will be readily apparent to those of ordinary skill in the art upon reading the following detailed description of the presently preferred, but nonetheless illustrative, embodiments when taken in conjunction with the accompanying drawings.

In this respect, before explaining the current embodiments of the telescopic paint pole system in detail, it is to be understood that the telescopic paint pole system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the telescopic paint pole system.

It is therefore important that the claims be regarded as including such equivalent construction insofar as they do not depart from the spirit and scope of the telescopic paint pole system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
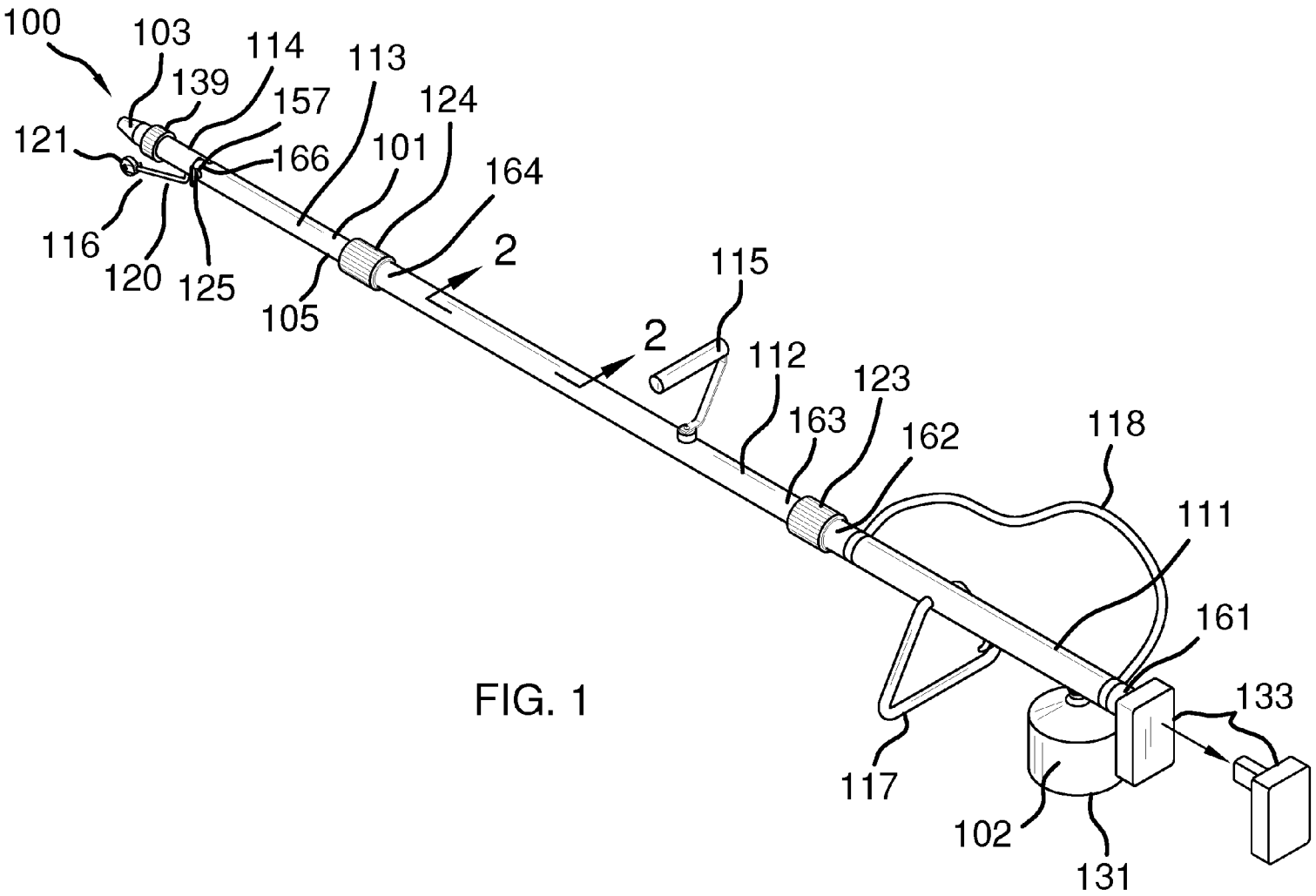
FIG. 1 is a perspective view of an embodiment of the disclosure.
Figure 2:
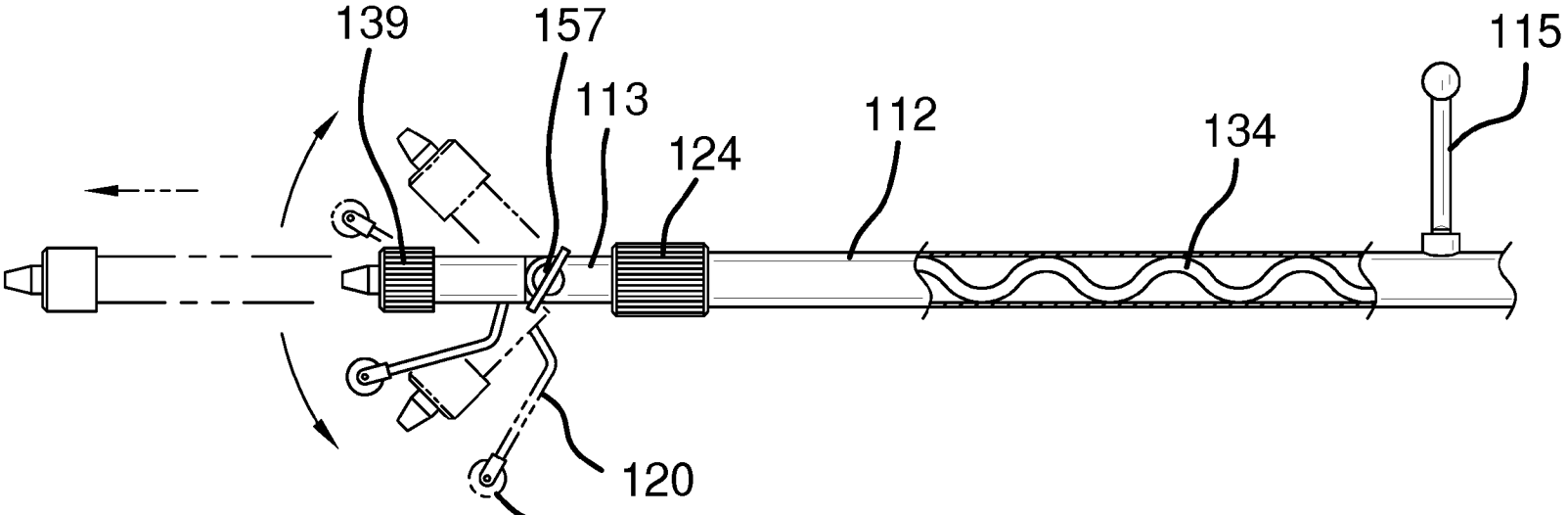
FIG. 2 is a cross-sectional view of an embodiment of the disclosure across 2-2 as shown in FIG. 1.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 8.

The telescopic paint pole system 100 (hereinafter invention) comprises a telescopic shaft 101, a paint pump system 102, and a spray head 103. The paint pump system 102 is integrated into the telescopic shaft 101. The spray head 103 is attached to the paint pump system 102. The invention 100 is an extensible spray painting system that is adapted for use in painting surfaces 171 without the use of a supporting structure such as a ladder. The spray head 103 is attached to the paint pump system 102. The spray head 103 is detachable and replaceable. The length of the telescopic shaft 101 is adjustable which allows for adjustment of the height the invention 100 can reach.

The telescopic shaft 101 comprises a first arm 111, a second arm 112, a third arm 113, and a tip arm 114. The first arm 111 is a hollow rigid cylindrical pipe that is further defined with a first end 161 and a second end 162. The second arm 112 is a hollow rigid cylindrical pipe that is further defined with a third end 163 and a fourth end 164.

The third arm 113 is a hollow rigid cylindrical pipe that is further defined with a fifth end 165 and a sixth end 166. The tip arm 114 is a hollow rigid cylindrical pipe that is further defined with a seventh end 167 and an eighth end 168.

The outer dimension of the second arm 112 is less than the inner dimension of the first arm 111 such that the second arm 112 can be inserted into the first arm 111 in a telescopic manner. This telescopic arrangement of the telescopic shaft 101 allows the length of the telescopic shaft 101 to be adjusted by adjusting the relative position of the second arm 112 within the first arm 111. The position of the second arm 112 relative to the first arm 111 is held in position using a first detent 123. The first detent 123 is a mechanical device that connects and secures the first arm 111 to the second arm 112. The outer dimension of the third arm 113 is less than the inner dimension of the second arm 112 such that the third arm 113 can be inserted into the second arm 112 in a telescopic manner. This telescopic arrangement of the telescopic shaft 101 allows the length of the telescopic shaft 101 to be adjusted by adjusting the relative position of the third arm 113 within the second arm 112.

The position of the third arm 113 relative to the second arm 112 is held in position using a second detent 124. The second detent 124 is a mechanical device that connects and secures the second arm 112 to the third arm 113. The outer dimension of the tip arm 114 is less than the inner dimension of the third arm 113 such that the tip arm 114 can be inserted into the third arm 113 in a telescopic manner. The position of the tip arm 114 relative to the third arm 113 is held in position using a third detent 125. The third detent 125 is a mechanical device that connects and secures the third arm 113 to the tip arm 114. The third detent 125 allows for the axis angle 106 of the center axis of the tip arm 114 relative to the center axis of the third arm 113 to be adjusted.

To assemble the telescopic shaft 101 the third end 163 of the second arm 112 is inserted into the second end 162 of the first arm 111 and is secured using the first detent 123. The fifth end 164 of the third arm 113 is inserted into the fourth end 164 of the second arm 162 and is secured using the second detent 124. The seventh end 167 of the tip arm 114 is inserted into the sixth end 166 of the third arm 113 and is secured using the third detent 125. The span of the length of the telescopic shaft 101 is along the direction of the center axes of the first arm 111, the second arm 112, and the third arm 113 is determined by the relative position of the first arm 111 to the second arm 112 and the relative position of the second arm 112 to the third arm 113. The axis angle 106 of the center axis of the tip arm 114 and the center axis of the third arm 113 is determined by and locked into position with the third detent 125.

The first detent 123 is selected from the group consisting of a cotter pin 151, a G snap collar 152, a threaded clutch 154, a split collar lock 155, or a spring loaded ball lock 156. The second detent 124 is selected from the group consisting of the cotter pin 151, the G snap collar 152, the threaded clutch 154, the split collar lock 155, or the spring loaded ball lock 156. The cotter pin 151, the G snap collar 152, the threaded clutch 154, the split collar lock 155, and the spring loaded ball lock 156 are all readily found and commercially available. The third detent 125 is a readily and commercially available locking universal joint 157.

The first arm 111 further comprises a rear handle 117, a strap 118, and a reservoir aperture 119. The reservoir aperture 119 further comprises an interior screw thread 122. The rear handle 117 is a grip that is attached to the first arm 111 to provide a hand hold for the purpose of controlling the invention 100 during use. The strap 118 is a strip of flexible material that is attached to the first arm 111 such that a loop is formed by the strap 118. This allows the strap 118 to be looped around the shoulder of a user thus allowing the bulk of the weight of the invention 100 to be better supported by the body. The reservoir aperture 119 is an aperture formed within the face of the first arm 111. The purpose of the reservoir aperture 119 is to provide access to the hollow interior of the first arm 111 such that paint can be drawn into the paint pump system 102 through the reservoir aperture 119.

The second arm 112 further comprises a front handle 115. The front handle 115 is a grip that is attached to the second arm 112 to provide a hand hold for the purpose of controlling the invention 100 during use. The third arm 113 further comprises a guide wheel 116. The guide wheel 116 further comprises a pole 120 and a wheel 121. The wheel 121 is attached to the pole 120. The pole 120 of the guide wheel 116 is a support and guide that is mounted at the sixth end 166 of the third arm 113. The guide wheel 116 is used such that the wheel 121 is positioned against and rolled along the painted surface 171 by the invention 100. This allows the spray head 103 to be held at a constant distance from the surface to be painted 171.

The paint pump system 102 comprises a reservoir 131, a pump 132, a battery 133, a flexible hose 134, and a valve 135. The reservoir 131 further comprises a container 136 and an exterior screw thread 137. The container 136 contains the fluid 172 which the paint pump system 102 will pump. While it is anticipated that the invention 100 will primarily be used with paints, the fluid 172 can be selected from the group consisting of a paint, a stain, a solvent, or water. The container 136 is further fitted with the exterior screw thread 137. The exterior screw thread 137 is designed to join the interior screw thread 122 of the first arm 111 such as to form a threaded connection that joins the reservoir to the first arm 111.

Figure 3:
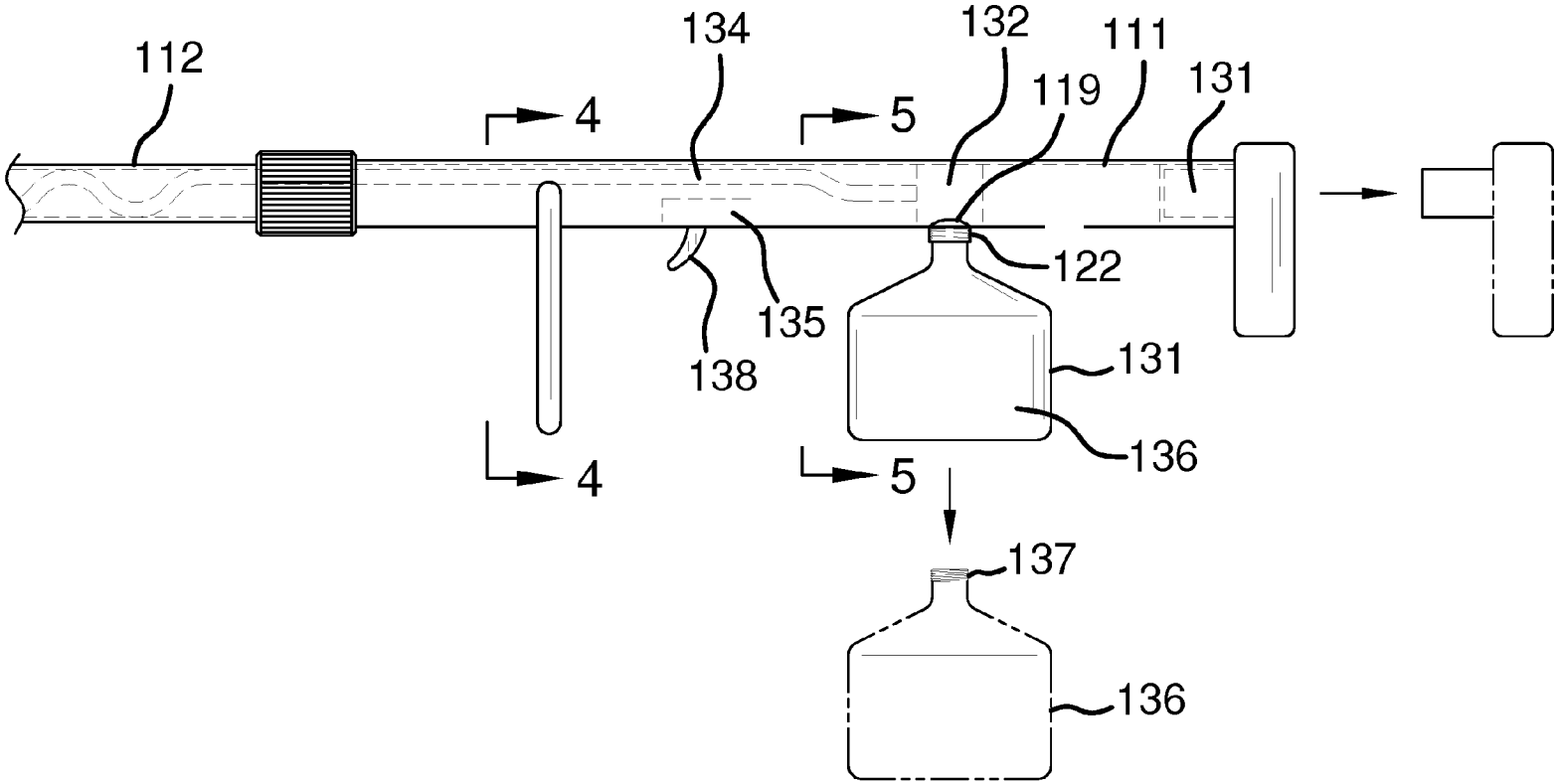
FIG. 3 is a side view of an embodiment of the disclosure.
Figure 5:
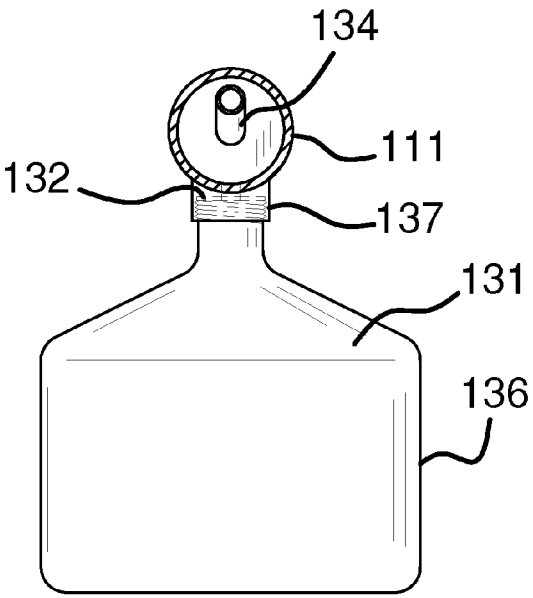
FIG. 5 is a cross-sectional view of an embodiment of the disclosure across 5-5 as shown in FIG. 4.
Figure 4:
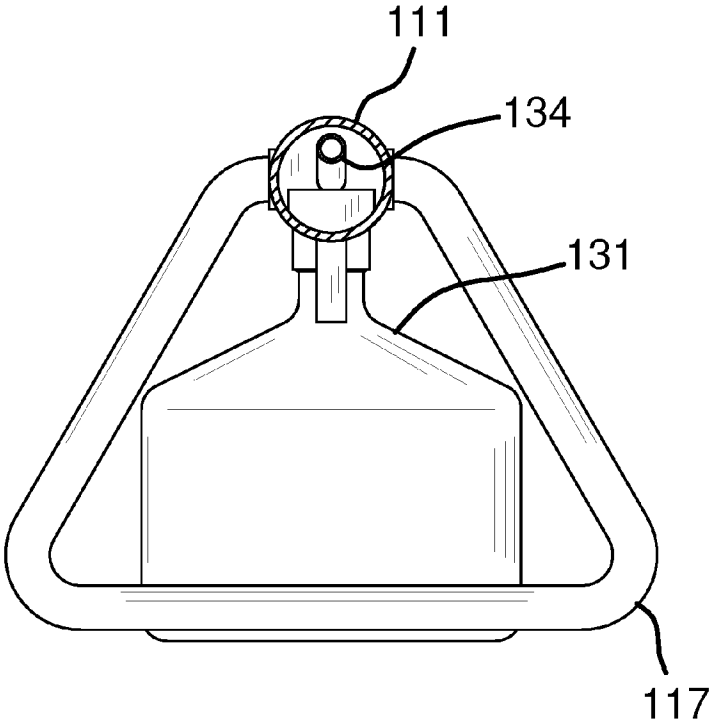
FIG. 4 is a cross-sectional view of an embodiment of the disclosure across 4-4 as shown in FIG. 3.
Figure 6A:
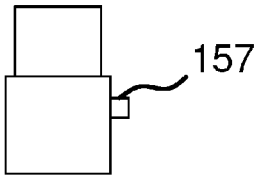
FIG. 6A is a detail view of an embodiment of the disclosure.
Figure 6B:
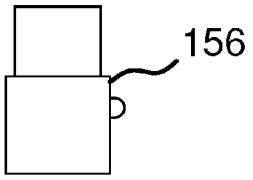
FIG. 6B is a detail view of an embodiment of the disclosure.
Figure 6C:
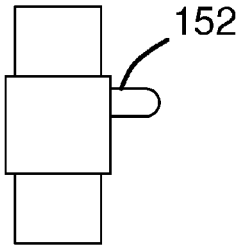
FIG. 6C is a detail view of an embodiment of the disclosure.
Figure 6D:
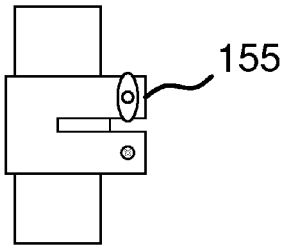
FIG. 6D is a detail view of an embodiment of the disclosure.
Figure 6E:
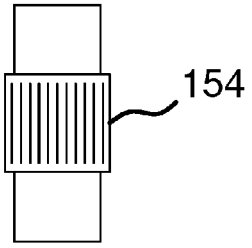
FIG. 6E is a detail view of an embodiment of the disclosure.
Figure 7:
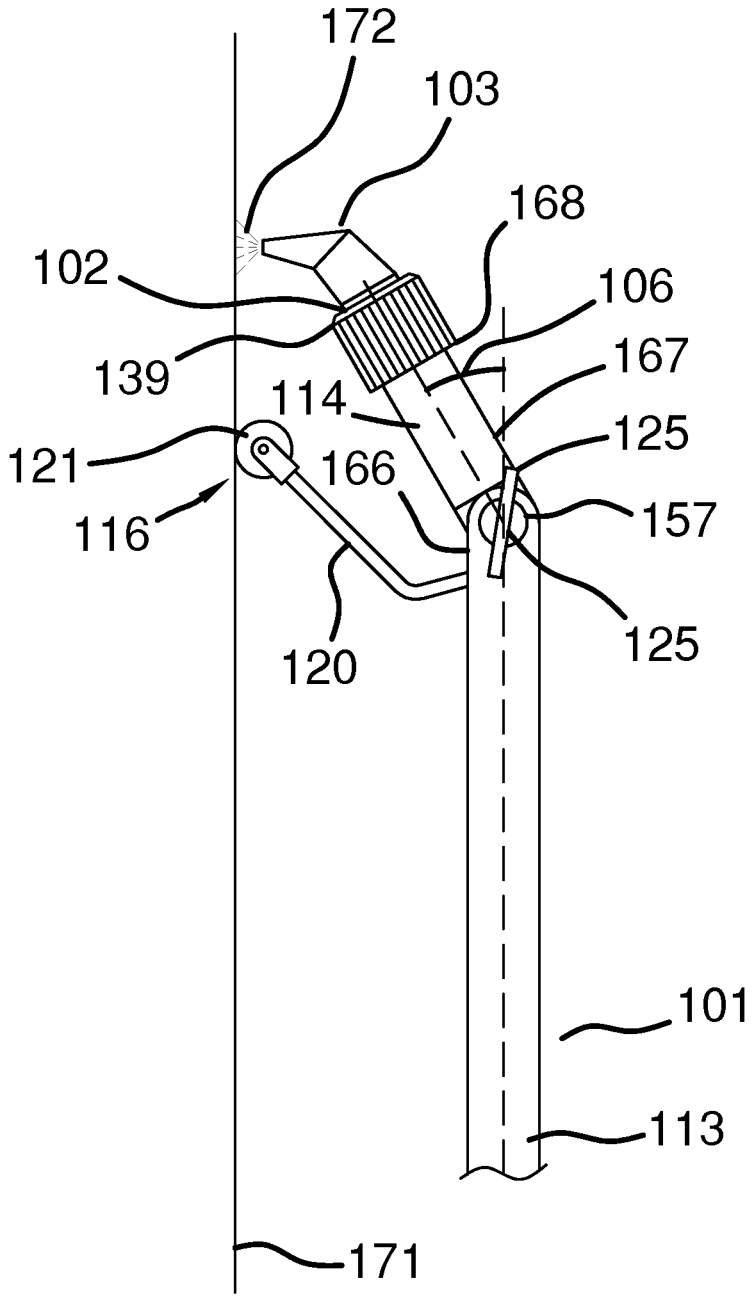
FIG. 7 is a detail view of an embodiment of the disclosure.
Figure 8:
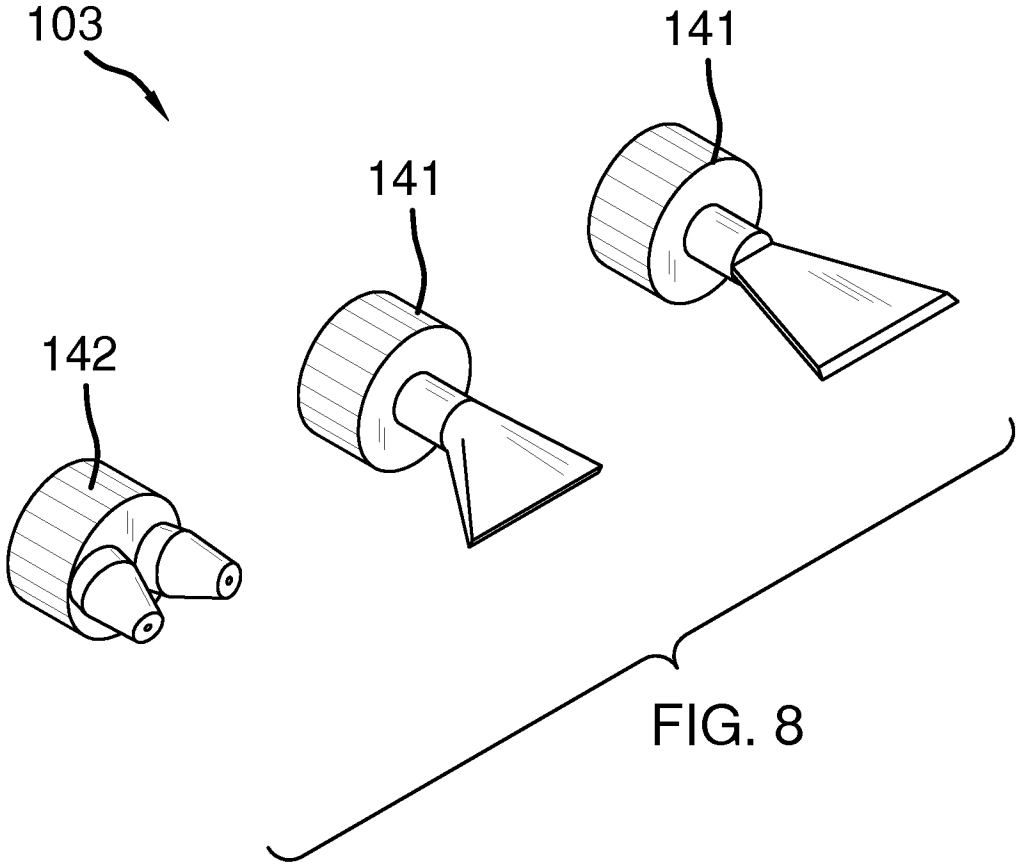
FIG. 8 is a view of an embodiment of the disclosure.

As shown most clearly in FIG. 3, the pump 132 is a readily and commercially available pump that is mounted in the interior of the first arm 111 such that the pump 132 is directly over the reservoir aperture 119. It is assumed in this disclosure that the pump 132 is powered by an internal electrical motor provided with the selected pump 132. The purpose of the pump 132 is to draw the fluid 172 from the reservoir 131, place the drawn fluid 172 under pressure and to discharge the drawn fluid 172 into the flexible hose 134. As shown most clearly in FIGS. 1 and 3, the electric motor of the pump 132 is powered using a readily and commercially available rechargeable battery 133 that is mounted on the first end 161 of the first arm 111. The flexible hose 134 is a hose that runs through the hollow interiors of the first arm 111, the second arm 113, the third arm 113, and the tip arm 114 from the pump 132 to the eighth end of the tip arm 114. The purpose of the flexible hose 134 is to transport the fluid 172, while under pressure, to the eighth end 168 of the tip arm 114 such that the fluid 172 can be delivered to the spray head 103.

As shown most clearly in FIG. 3, the valve 135 is a readily and commercially available trigger 138 valve 135 that is placed within the fluid 172 flow of the flexible hose 134 and that is used to control the volume of fluid 172 that will flow through the flexible hose 134 at any point in time. The valve 135 is mounted inside the first arm 111 such that the trigger 138 of the valve 135 is accessible from the exterior of the first arm 111.

The flexible hose 134 and the eighth end 168 of the tip arm 114 are joined together using a fitting 139 that allows a spray head 103 to be attached directly to the flexible hose 134. Such fittings are commercially available. The purpose of the spray head 103 is to receive the fluid 172 under pressure and to release that fluid 172 towards the surface to be painted 171. The spray head 103 is interchangeable such that the spray head 103 can be adapted to the fluid 172 being used. For example, when water or a solvent is selected for use as the fluid 172, a jet spray head 141 would be appropriate as the spray head 103. When a paint or a stain is selected for use as the fluid 172, an atomizing spray head 142 would be appropriate as the spray head 103.

The following definitions were used in this disclosure:

Battery: As used in this disclosure, a battery is a container consisting of one or more cells, in which chemical energy is converted into electricity and used as a source of power.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cotter Pin: As used in this disclosure, a cotter pin is a metal shaft that is used to hold two mechanical components together.

Detent: As used in this disclosure, a detent is a device for positioning and holding one mechanical part in relation to another in a manner such that the device can be released by force applied to one or more of the parts.

Electric Motor: In this disclosure, an electric motor is a machine that converts electric energy into rotational mechanical energy.

Exterior Screw Thread: An exterior screw thread is a ridge wrapped around the outer surface of a tube in the form of a helical structure that is used to convert rotational movement into linear movement.

Handle: As used in this disclosure, a handle is an object by which a tool, object, or door is held or manipulated with the hand.

Hose: As used in this disclosure, a hose is a flexible hollow cylindrical device that is used for transporting liquids and gasses. When referring to a hose in this disclosure, the terms inner diameter and outer diameter are used as they would be used by those skilled in the plumbing arts.

Inner Diameter: As used in this disclosure, the term inner diameter is used in the same way that a plumber would refer to the inner diameter of a pipe.

Interior Screw Thread: An interior screw thread is a groove that is formed around the inner surface of a tube in the form of a helical structure that is used to convert rotational movement into linear movement.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Outer Diameter: As used in this disclosure, the term outer diameter is used in the same way that a plumber would refer to the outer diameter of a pipe.

Paint: As used in this disclosure, when used as a noun the term paint refers to a pigment based colloid or solution that is applied to a surface as a coating of the surface. When used as a verb, the term paint refers to the application of paint to a surface.

Pipe: As used in this disclosure, a pipe is a hollow cylindrical device that is used for transporting liquids and gasses. In this disclosure, the terms inner diameter of a pipe and outer diameter are used as they would be used by those skilled in the plumbing arts.

Pump: As used in this disclosure, a pump is a mechanical device that uses suction or pressure to raise or move liquids, compress gasses, or force a gas into an inflatable object.

Spring Loaded Lock Ball: As used in this disclosure, a spring loaded lock is a detent formed from a spring loaded bearing located in a first object which retracts and then snaps into an opposing hole or groove formed in a second object to hold the second object in position. They are also commonly referred to as ball detents, spring loaded plungers, spring plungers, and ball locks.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Telescopic: As used in this disclosure, telescopic is an adjective that describes an object made of sections that fit or slide into each other such that the object can be made longer or shorter by adjusting the relative positions of the sections.

Textile: As used in this disclosure, a textile is a material that is woven, knitted, braided or felted. Synonyms in common usage for this definition include fabric and cloth.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Universal Joint: As used in this disclosure, a universal joint is a method of joining a first shaft to as second shaft such that the center axis of the first shaft and is offset from the center axis of the second shaft. When a universal joint is formed with a locking mechanism, a universal joint can further be used to lock the angle between the first shaft and the second shaft into a fixed position. Universal joints are often used to transfer rotation from the first shaft to rotate the second shaft.

Valve: As used in this disclosure, a valve is a device that is use to control the flow of a fluid (gas or liquid) through a pipe.

Wheel: As used in this disclosure, a wheel is a circular object that revolves around an axle or an axis and is fixed below an object to enable it to move easily over a surface. For the purpose of this disclosure, it is assumed that a wheel can only revolve in a forward and a backward direction.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A spray device comprising:

a telescopic shaft, a paint pump system, and a spray head;

wherein the paint pump system is integrated into the telescopic shaft;

wherein the spray head is attached to the paint pump system;

wherein the spray device is detachable and replaceable;

wherein the spray device is extensible;

wherein the length of the telescopic shaft is adjustable;

wherein the spray device is adapted for use in preparing surfaces for painting;

wherein the spray device is adapted for use in painting surfaces;

wherein the telescopic shaft comprises a first arm, a second arm, a third arm, and a tip arm;

wherein the first arm is a hollow rigid cylindrical pipe that is further defined with a first end and a second end;

wherein the second arm is a hollow rigid cylindrical pipe that is further defined with a third end and a fourth end;

wherein the third arm is a hollow rigid cylindrical pipe that is further defined with a fifth end and a sixth end;

wherein the tip arm is a hollow rigid cylindrical pipe that is further defined with a seventh end and an eighth end;

wherein the first arm, the second arm, the third arm, and the tip arm are interconnected;

wherein the outer dimension of the second arm is less than the inner dimension of the first arm such that the second arm can be inserted into the first arm in a telescopic manner;

wherein the outer dimension of the third arm is less than the inner dimension of the second arm such that the third arm can be inserted into the second arm in a telescopic manner;

wherein the position of the second arm relative to the first arm is held in position using a first detent;

wherein the position of the third arm relative to the second arm is held in position using a second detent;

wherein the position of the tip arm relative to the third arm is held in position using a third detent;

wherein the length of the telescopic shaft is adjusted by adjusting the relative position of the second arm within the first arm;

wherein the length of the telescopic shaft is adjusted by adjusting the relative position of the third arm within the second arm;

wherein the third end of the second arm is inserted into the second end of the first arm and is secured using the first detent;

wherein the fifth end of the third arm is inserted into the fourth end of the second arm and is secured using the second detent;

wherein the seventh end of the tip arm is secured using the third detent;

wherein the third detent adjusts the axis angle of the center axis of the tip arm relative to the center axis of the third arm;

wherein the axis angle of the center axis of the tip arm and the center axis of the third arm is locked into position with the third detent;

wherein the first detent is selected from the group consisting of a cotter pin, a G snap collar, a threaded clutch, a split collar lock, and a spring loaded ball lock;

wherein the second detent is selected from the group consisting of the cotter pin, the G snap collar, the threaded clutch, the split collar lock, and the spring loaded ball lock;

wherein the first arm further comprises a rear handle, a strap, and a reservoir aperture;

wherein the reservoir aperture further comprises an interior screw thread;

wherein the rear handle is a first grip attached to the first arm;

wherein the strap is a strip of flexible material that is attached to the first arm such that a loop is formed by the strap;

wherein the reservoir aperture is an aperture formed within a face of the first arm that provides access to hollow interior of the first arm;

wherein the second arm further comprises a front handle;

wherein the front handle is a second grip attached to the second arm;

wherein the third arm further comprises a guide wheel;

wherein the guide wheel further comprises a pole and a wheel;

wherein the wheel is attached to the pole;

wherein the pole mounts at the sixth end of the third arm;

wherein the guide wheel holds the spray head at a constant distance from the painted surface;

wherein the paint pump system comprises a reservoir; a pump, a battery, a flexible hose, and a valve;

wherein the reservoir further comprises a container and an exterior screw thread;

wherein the container contains the fluid which the paint pump system will pump;

wherein the container is fitted with the exterior screw thread;

wherein the exterior screw thread joins the interior screw thread of the first arm such as to form a threaded connection that joins the reservoir to the first arm;

wherein the pump is mounted in the interior of the first arm such that the pump is directly over the reservoir aperture;

wherein the pump is powered by the battery;

wherein the pump draws the fluid from the reservoir;

wherein the pump places the drawn fluid under pressure;

wherein the pump discharges the drawn fluid into the flexible hose;

wherein the battery is a rechargeable battery;

wherein the battery is mounted on the first end of the first arm;

wherein the flexible hose is a hose that runs through the hollow interiors of the first arm, the second arm, the third arm, and the tip arm from the pump to the eighth end of the tip arm;

wherein the flexible hose is to transports the fluid to the eighth end of the tip arm such that the fluid is delivered to the spray head.

2. The spray device according to claim 1 wherein the paint pump system further comprises a valve;

wherein the valve is a trigger valve that is placed within the fluid flow of the flexible hose;

wherein the valve is mounted inside the first arm such that the trigger of the valve is accessible from the exterior of the first arm.

3. The spray device according to claim 2 wherein the flexible hose and the eighth end of the tip arm are joined together using a fitting that allows a spray head to be attached directly to the flexible hose;

wherein the spray head receives and to releases the fluid towards the surface to be painted.

4. The spray device according to claim 3 wherein the spray head is selected from the group consisting of a jet spray head and an atomizing spray head.

5. The spray device according to claim 4 wherein the fluid is selected from the group consisting of a paint, a stain, a solvent, and water.

* * * * *